United States Patent [19]

Mott

[11] 4,030,550

[45] June 21, 1977

[54] METHOD OF OPERATING A SUBSURFACE SAFETY VALVE IN RESPONSE TO AN INCREASE OR DECREASE IN AMBIENT WELL FLUID PRESSURE

[75] Inventor: James D. Mott, Houston, Tex.

[73] Assignee: Hydril Company

[22] Filed: Jan. 7, 1976

[21] Appl. No.: 646,993

Related U.S. Application Data

[60] Division of Ser. No. 566,202, April 9, 1975, Pat. No. 3,987,849, which is a continuation of Ser. No. 399,455, Sept. 21, 1973, abandoned, which is a division of Ser. No. 214,679, Jan. 3, 1972, Pat. No. 3,788,594.

[52] U.S. Cl. ..... 166/314; 137/458; 166/322

[51] Int. Cl.[2] ..... E21B 43/12

[58] Field of Search ..... 166/315, 224 A; 137/358, 458, 461, 494; 251/58, 62

[56] References Cited

UNITED STATES PATENTS

| | | | |
|---|---|---|---|
| 3,050,132 | 8/1962 | Page | 137/460 |
| 3,071,151 | 1/1963 | Sizer | 166/224 A |
| 3,310,114 | 3/1967 | Dollison | 166/224 A |
| 3,410,346 | 11/1968 | Garrett et al. | 166/224 R |
| 3,768,506 | 10/1973 | McGill | 137/458 |

*Primary Examiner*—James A. Leppink
*Attorney, Agent, or Firm*—Pravel, Wilson & Gambrell

[57] ABSTRACT

A subsurface safety valve well tool securable in a well conduit for controlling flow of fluid through the bore of the conduit. An increase or decrease in the well pressure from the normal flowing pressure of the well operates a rotatable ball valve to block flow of fluid through the conduit. Increasing and then decreasing the pressure in the bore above the ball valve rotates the valve to enable flow of fluid through the conduit.

10 Claims, 24 Drawing Figures

31a
32c
32g
32a
31e
32e
31
25
32b
35a
35
35b
32f
32
32h
34f
35c
34d
F
34c
S
34e
32d
34
37
75

34
37
75
32
32d
31
34a
25
34b
34a
71g
30
32i
70
71
71c
71i
71h
71h
71a
71j
71k
71f
71m
71e
71g
71d
71p
S
F
81c
81
81b
81a
81d
82
71n 62a
71n
62
31i
31
62b
61a
61g
71b
25
71q
61d
61c
71s
7
61h
73
72f
71r
61f
71t
61e
72
61i
82
72a
74
74a
72c
72b
72e
8
72d
65
63g
63f
63e
61
63
33
63d
63c
33e
9
33a
61k
61m
63b
60
61b
66b
66a
F 63
64
66a
64a
66b
63a
10
66
33a
67
31
25
F
67c
7
67a
67b
53g
53f
53d
33i
55a
33h
55
33j
53e
8
53f
53c
53
33
53b
54
52b
53a
52
50
52a
9
10

32d
37
34
31
34a
34b
34a
75
71g
32i
70
71a
171h
71k
71d
71p
81b
81
81a
82
71b
62a
62
71n 62b
61a
82
61g
72b
31
71g
72s
72a
61
73
72
61e
74
72c
61i
72b
72d
65
63g
63f
63e
63
63d
63c
33e
61
33a
61k
60
66b
64
61b 53
52
50
51
31g
31f
33a
31c
25
31
31d
41b
41c
34
41
33d
33b
40b
40
41a
42a
40d
40c
40a 53f
55a
33j
33i
55
33h
53f
53e
53
54
25
52
50
51
31g
31f
31
31c
41b
31d
41
34
41c
33a 33a
25
41
33d
33b
40b
40
41a
40c
40d
44
33d
44d
44e
33c
33g
33f 37
34
75
25
32d
31
34a
34b
34a
71g
32i
70
71a
171h
71i
71h
71j
71m
71k
71b
71p
71d 71p
71n
81
82
62a
62
71b
62b
61a
61g
25
71g
61
71s
71r
73
71t
61e
61i
74
72d
65
63g
63f
63e
31
63
61
33g 63
61
63c
61k
33a
60
61m
61b
66b
66a 64
66
67
31
67c
67a
67b 34
37
32d
25
34a
34b
34a
75
31
71g
32i
70
71a
71i
71h
71p
71d
81
82
62a
62b 71n
71b
61g
71g
61
71s
73
61h
61f
71r
71t
61e
74a
72
72b
72d
63g
65
63e
63c
33e
63
33a
63b
61k
60
61m
64

METHOD OF OPERATING A SUBSURFACE SAFETY VALVE IN RESPONSE TO AN INCREASE OR DECREASE IN AMBIENT WELL FLUID PRESSURE

This is a division of application Ser. 1975, 566,202 filed Apr. 9, 1975 now Pat. No. 3,987,849 which is a continuation of application Ser. No. 399,455, filed Sept. 21, 1973 now abandoned which is a division of application Ser. No. 214,679, filed Jan. 3, 1972 and which issued on Jan. 29, 1974 as U.S. Pat. No. 3,788,594.

CROSS REFERENCE TO RELATED APPLICATION

This application is related to my copending application entitled "WELL TOOL" Ser. No. 214,734, filed Jan. 3, 1972 and now U.S. Pat. No. 3,821,962.

BACKGROUND OF THE INVENTION

This invention relates to the field of subsurface valves for controlling flow of fluid through the bore of well conduit.

My copending application for a "WELL TOOL", Ser. No. 214,734, discloses a subsurface safety valve for blocking flow of fluid through a production string at a subsurface location by utilizing the well surface controls to effect a sequence of well pressure changes to operate the valve. That invention performed a valuable service but provided no means for preventing flow through the string or conduit when the surface control equipment was destroyed, damaged, or otherwise rendered inoperable before shutting in the well. Prior subsurface safety valves for controlling a full bore flow in a well, resulting from the destruction of the surface controls and the like, have been unreliable in wells having high allowable production rates due to the relatively small well pressure difference between normal well-flowing pressure and full bore well-flowing pressure.

An object of the present invention is to provide a new and improved well tool.

Another object of the present invention is to provide a new and improved subsurface safety valve operable by changes in the well pressure.

SUMMARY OF THE INVENTION

A subsurface well tool securable in the bore of a production tubing for controlling flow of fluid through the bore of the tubing includes a flow control assembly and a ball-type bore closure means. The ball is moved to and locked in a open position by means with the flow control assembly for enabling flow through the bore of the tubing by sequentially increasing and decreasing the pressure in the bore of the tubing above the ball. A subsequent increase or decrease in the pressure in the bore of the tubing from the normal well-flowing pressure operates a reference chamber pressure biased piston means to release and effect rotation of the ball to the closed position to block flow through the bore. The flow control assembly includes means for delaying closing movement of the ball when the well pressure decreases below the normal flowing pressure until the pressure reaches a predetermined value.

DESCRIPTION OF THE PREFERRED EMBODIMENTS

Figures 1A, 1B:
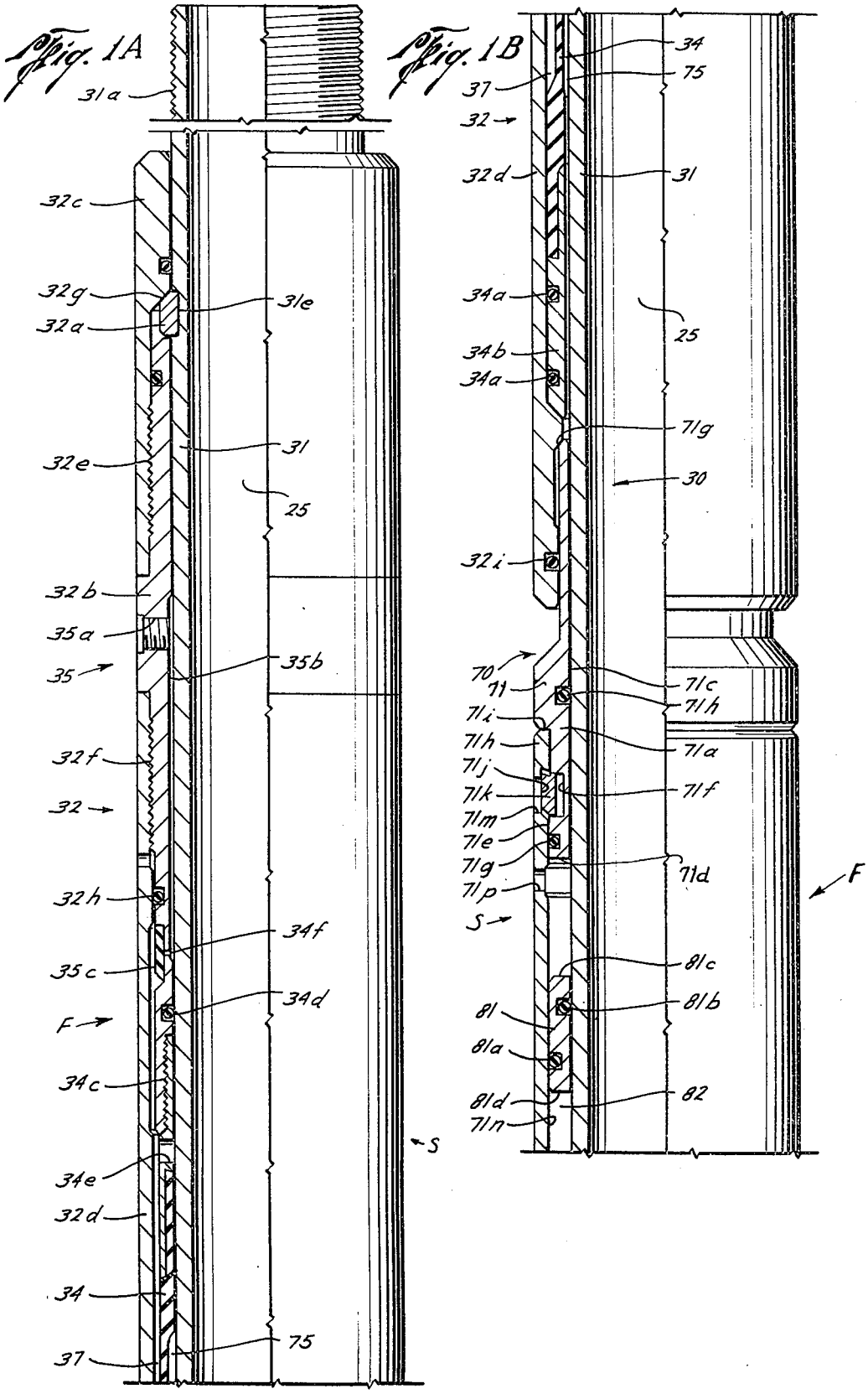
FIGS. 1A, 1B, 1C, 1D, 1E, and 1F are side views, partially in section, from top to bottom of the well tool of the present invention in the closed position.

Attention is directed to the figures where the well tool of the present invention is illustrated in greater detail. The well tool is connected at its upper end, as will be explained, to a mandrel tool (not shown) and the connected tools are then secured in the bore of a conduit or tubing (not illustrated) by the mandrel at a subsurface location to control the flow of fluid through the bore of the tubing. Reference is made to my copending application, Ser. No. 214,734, which illustrates and sets forth in greater detail the relationships between the tubing, the mandrel, and the well tool.

The well tool, generally designated S, includes a flow control assembly F having a bore closure means B mounted therwith for controlling flow through the bore of the tubing. The bore closure means B is moved to the open position to enable flow through the bore of the tubing and is moved to the closed position to block flow through the bore of the tubing as will be explained.

As illustrated in FIGS. 1A, 1B, 1C, 1D, 1E, and 1F, the flow control assembly F for supporting and effecting movement of the bore closure means B includes an elongated tubular member 31, a movable slide means 33, a piston means 70 and a means for providing a reference urging on the piston means 70. The tubular member 31 includes threads 31*a* formed on the outer surface adjacent the upper end of the member 31 (FIG. 1A) to connect the well tool S with the mandrel. The tubular member 31 extends downwardly from the mandrel for providing a fixed support body for the well tool S to a concentric ring member 31*c* (FIG. 1E) secured thereto at threads 31*b* adjacent the lower end of the tubular member 31. The inner surface of the tubular member 31 defines a portion of a bore 25 extending through the tubular member 31 along a longitudinal axis to provide a flow passage through the flow control assembly F.

The means for providing a reference urging on the piston means includes a pressure reservoir means 32 comprising a securing ring 32*a*, a base sleeve 32*b*, a cap sleeve 32*c*, a reservoir sleeve 32*d*, and a diaphragm 34. The ring 32*a* (FIG. 1A) is locked within a recess 31*e* formed in the outer surface of the tubular member 31 for securing the reservoir means 32 with the tubular member 31. For ease of assembly the base sleeve 32*b* and the cap sleeve 32*c* are secured together by threads 32*e* while threads 32*f* secured the reservoir sleeve 32*d* with the sleeve 32*b*. The sleeves 32*b* and 32*c* engage the protruding portion of the ring 32*a* to prevent longitudinal movement of the reservoir means 32 relative to the tubular member 31. Engagement of the tapered upwardly facing annular surface 32*g* of the snap ring 32*a* with the cap sleeve 32*c* maintains the ring 32*a* in the recess 31*e* of the member 31. An O-ring 32*h* seals between the sleeve 32*b* and the sleeve 32*d* adjacent the threads 32*f* to prevent leakage of fluid therebetween.

The flexible diaphragm member 34 is positioned within the concentric annular space formed between the inner surface of the reservoir sleeve 32*d* and the outer surface of the tubular member 31 for containing a charged reference fluid pressure as will be explained. The lower end of the sleeve-shaped diaphragm member 34 (FIG. 1B) is sealed to the inner surface of the sleeve 32*d* with a pair of O-rings 34*a* located in corresponding recesses in the outer surface of a ring member 34*b* secured to the diaphragm 34. The ring 34*b* is spaced from the outer surface of the member 31 to form an annular flow passage therebetween. The upper end of the diaphragm 34 (FIG. 1A) has a ring member 34*e* secured to the sleeve 32*b* by threads 34*c*. The diaphragm 34 is sealed to the outer surface of the tubular member 31 to prevent leakage of fluid therebetween by an O-ring 34*d* located in a recess in the inner surface of the ring 34*e*.

An expansible charged fluid reference pressure reservoir 37 is thus formed by portions of the inner surface of the sleeve 32*d*, the lower shoulder and outer surface of the sleeve 32*b*, the outer surface of the ring 34*e*, and the outer surface of the flexible diaphragm 34.

As illustrated in FIG. 1A, the pressure reservoir means 32 also includes a means 35 for filling or charging the reservoir 37. The means for filling the reservoir 37 includes a threaded refill connection port 35*a* communicating through an annular channel 35*b* with a port opening 34*f* which are all located in the sleeve 32*b*. A flapper check valve member 35*c*, secured at the upper edge to the sleeve 32*b* enables communication or flow through the port 34*f* into the reservoir 37 by flexing away from the opening 34*f*, but prevents flow from the reservoir 37 by moving to cover the port 34*f*.

The piston means 70 (FIGS. 1B and 1C) is concentrically mounted on the outer surface of the tubular member 31 and is longitudinally movable relative thereto in response to the urgings thereon. The piston or plunger 71 is preferably made in two portions for ease of assembly and includes an upper portion 71*a* connected to a lower portion 71*b* to form a sleeve-like unit. The upper portion 71*a* includes a constant diameter movement guiding inner surface 71*c* adjacent the outer surface of the tubular member 31, a downwardly facing pressure responsive annular shoulder surface 71*d*, an outer surface portion 71*e* having a recess 71*f* formed therein and an upwardly facing pressure responsive annular surface 71*g*. The sleeve is sealed to the piston 71 to prevent the passage of fluid therebetween by an O-ring 32*i* while an O-ring 71*h* effects a seal between the piston 71 and the tubular member 31. Preferably, the annular pressure responsive surfaces 71*d* and 71*g* have equal effective surface areas for the pressure to urge on, which is provided by sealing the piston 71 above the taper of the surface 71*e* with the O-ring 32*i*. The sleeve 71*g* includes a downwardly facing shoulder 71*h* for engaging the lower portion 71*b* to impart downwardly movement thereto. The lower sleeve portion 71*b* is secured to the upper portion 71*a* by a detent member 71*k* with an upper annular shoulder 71*i* engaging the downwardly-facing shoulder 71*h* for imparting the downwardly movement to the sleeve 71*b*. The engagement of the shoulder 71*h* and 71*i* also aligns an annular recess 71*j* in the inner surface of the sleeve 71*b* with the recess 71*f* in the upper portion 71*a* to enable the gapped spring detent ring 71*k* within the annular recess 71*f* to expand radially into the recess 71*j* to secure the sleeve portions 71*a* and 71*b* together. A port 71*m* extends through the sleeve 71*b* adjacent the detent 71*k* to enable disassembly of the piston 71 by providing a means for moving the detent ring 71*k* out of the recess 71*j*. The plunger sleeve 71*b* includes a constant diameter inner surface 71*n* spaced from the member 31 and a port 71*p* formed through the sleeve 71*b* adjacent the shoulder 71*d* for communicating the well pressure to the pressure responsive surface 71*d*.

The portion of the pressure reservoir means 32 adjacent the piston pressure responsive surface 71*g* and defined by the inner surface of the diaphragm 34 and the outer surface of the member 31 form a chamber 75 which is filled with oil or another liquid for transmitting the urging of the charged pressure in the chamber 37 to the piston 71 for urging the piston 71 to move downwardly. The well pressure communicated through the port 71*p* urges on the surface 71*d* for urging the piston 71 to move upwardly in response to the well pressure in the bore of the tubing.

Figures 1C, 1D:
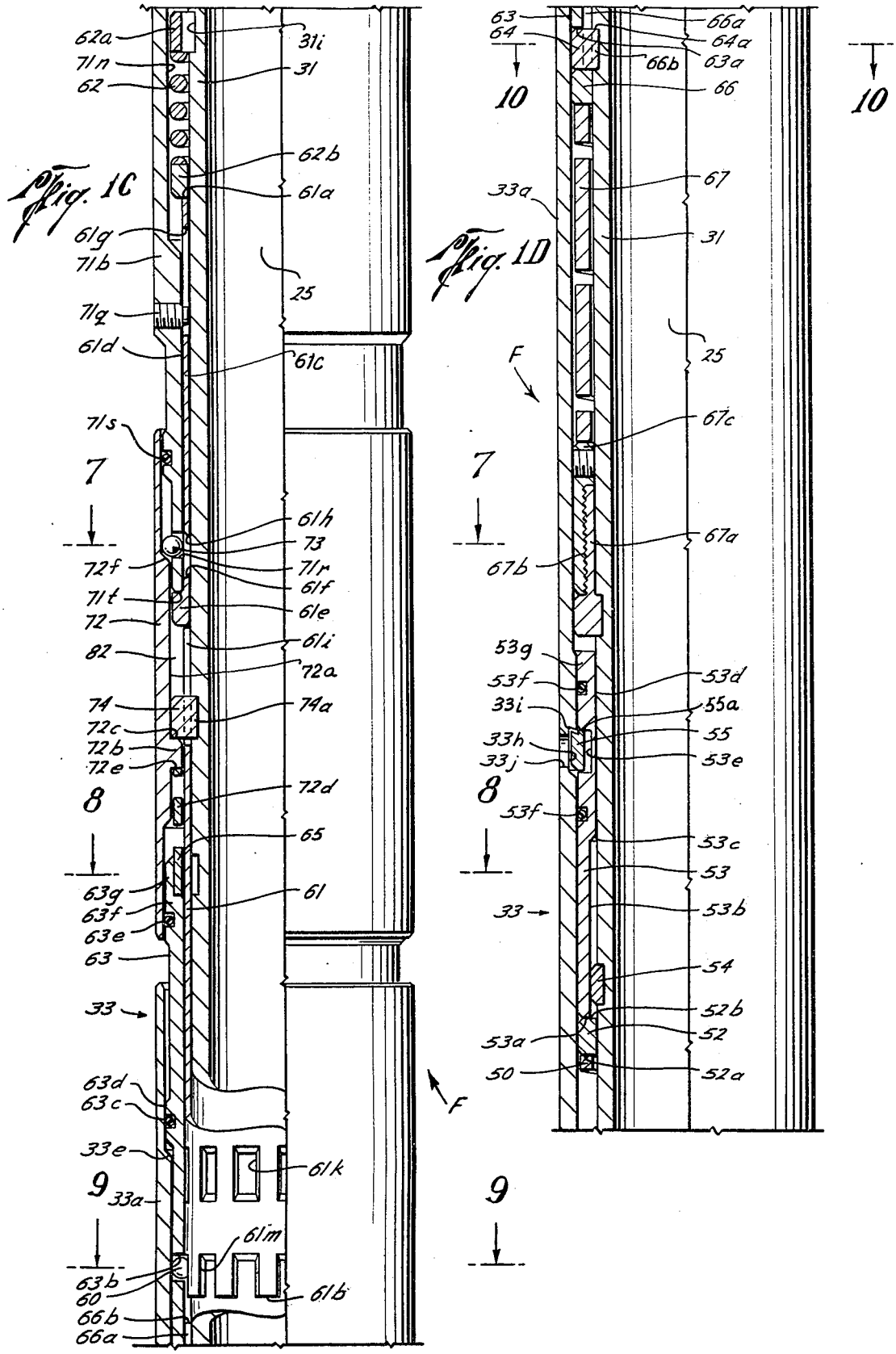
Figure 1E:
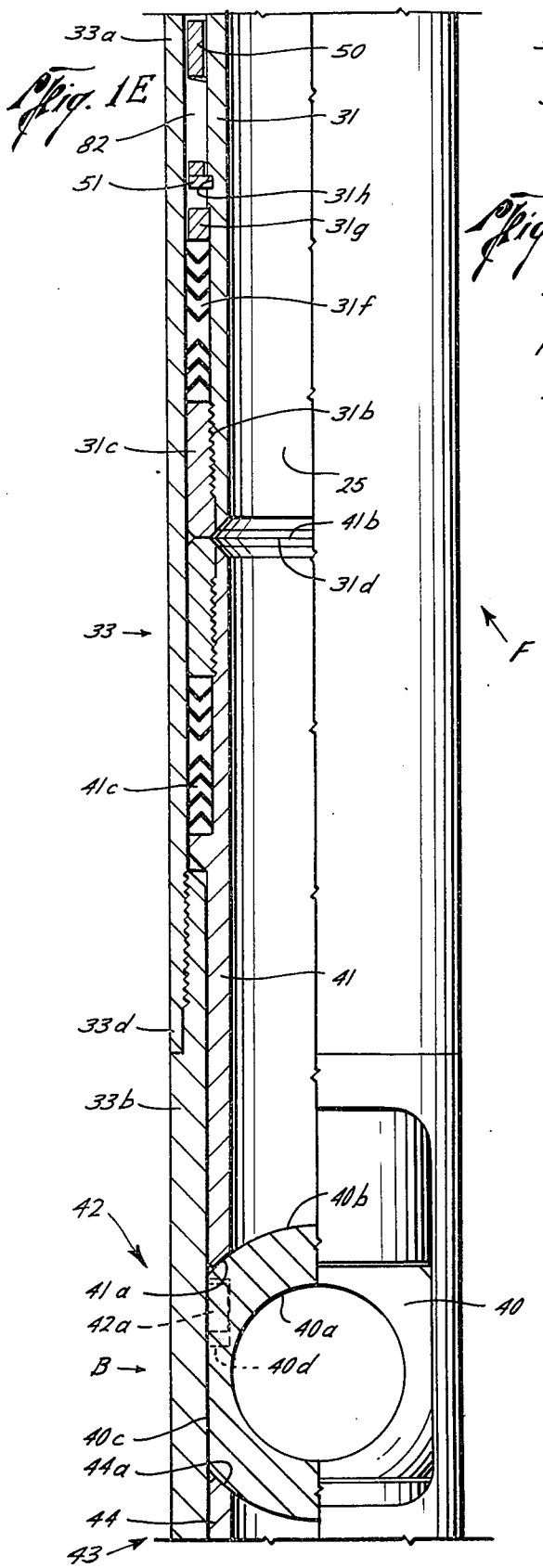
Figure 1F:
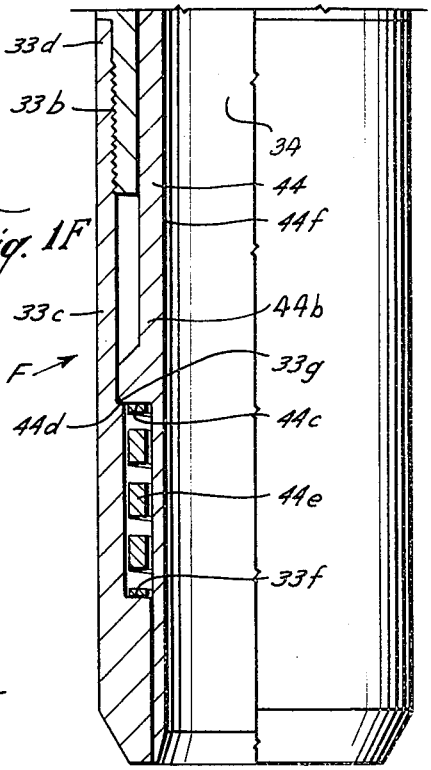
Figure 7:
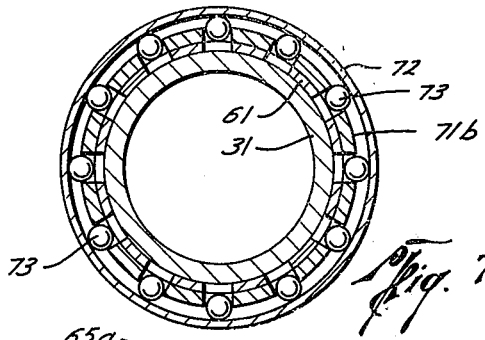
FIGS. 7, 8, and 9 are views taken along lines 7—7, 8—8, and 9—9, respectively, of FIG. 1C.
Figure 3A:
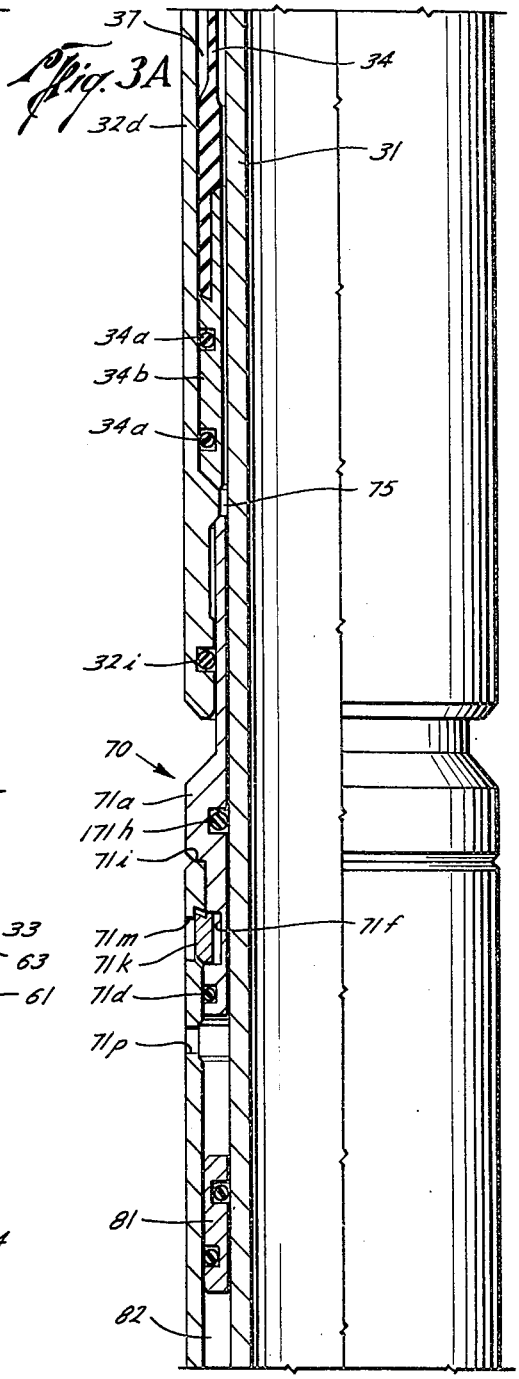
FIGS. 3A, 3B, 3C, and 3D are side views partially in section, illustrating movement of the valve to the open position.
Figure 9:
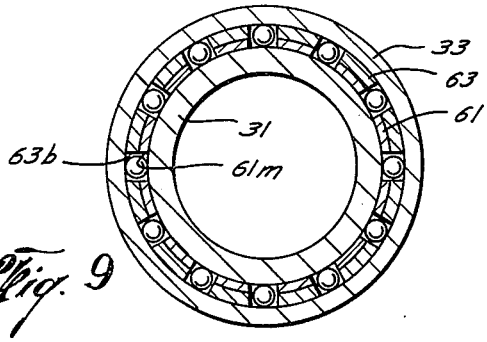
Figure 3B:
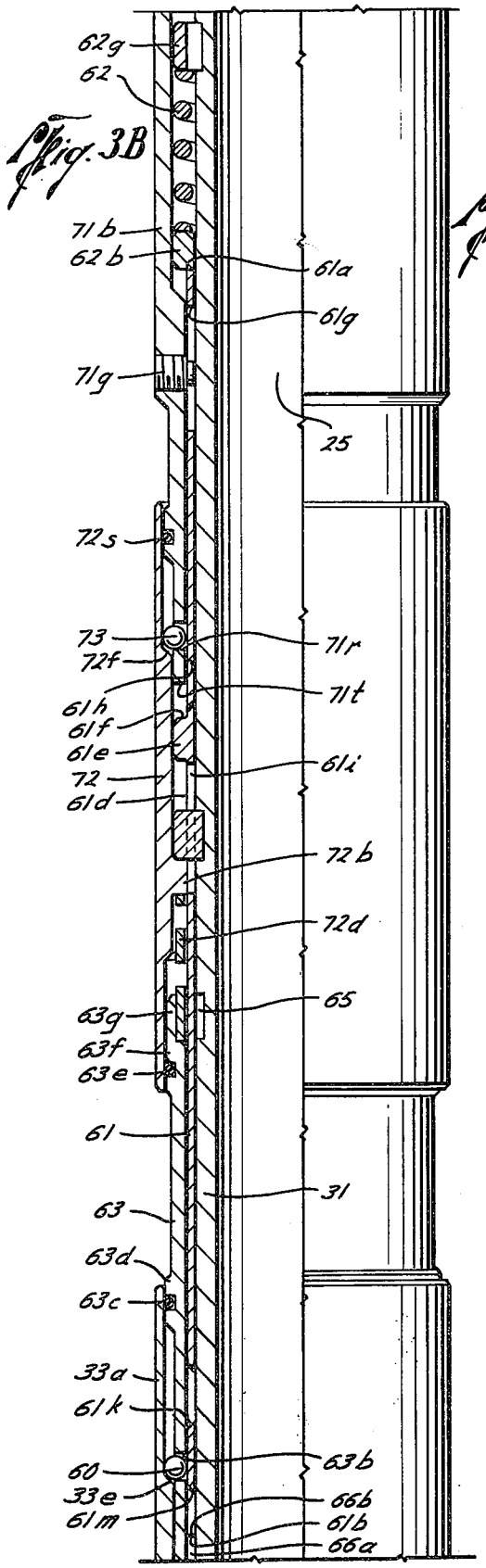
Figure 3C:
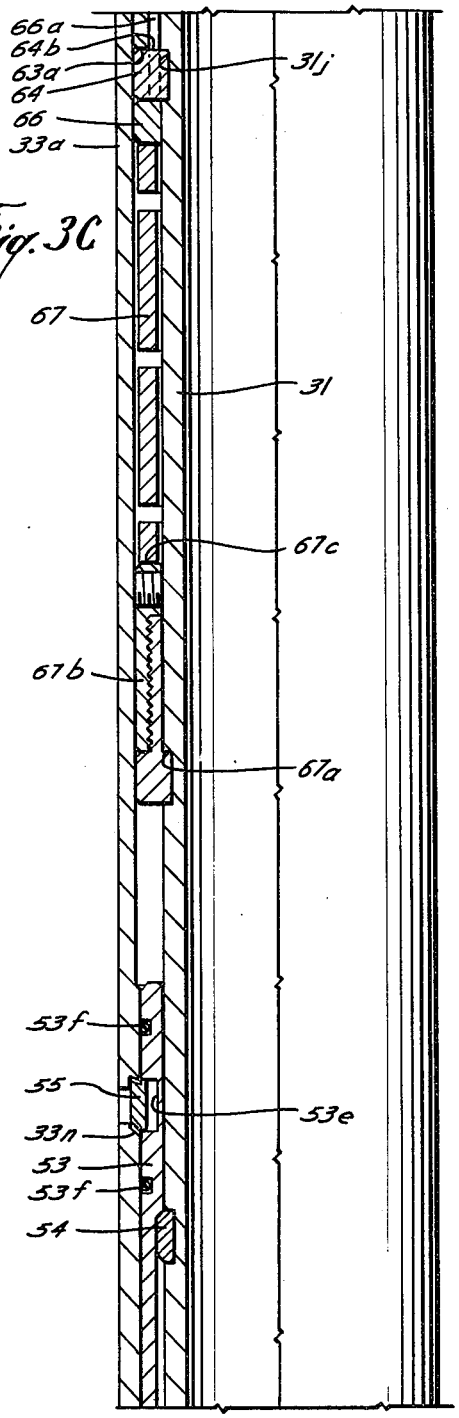
Figure 3D:
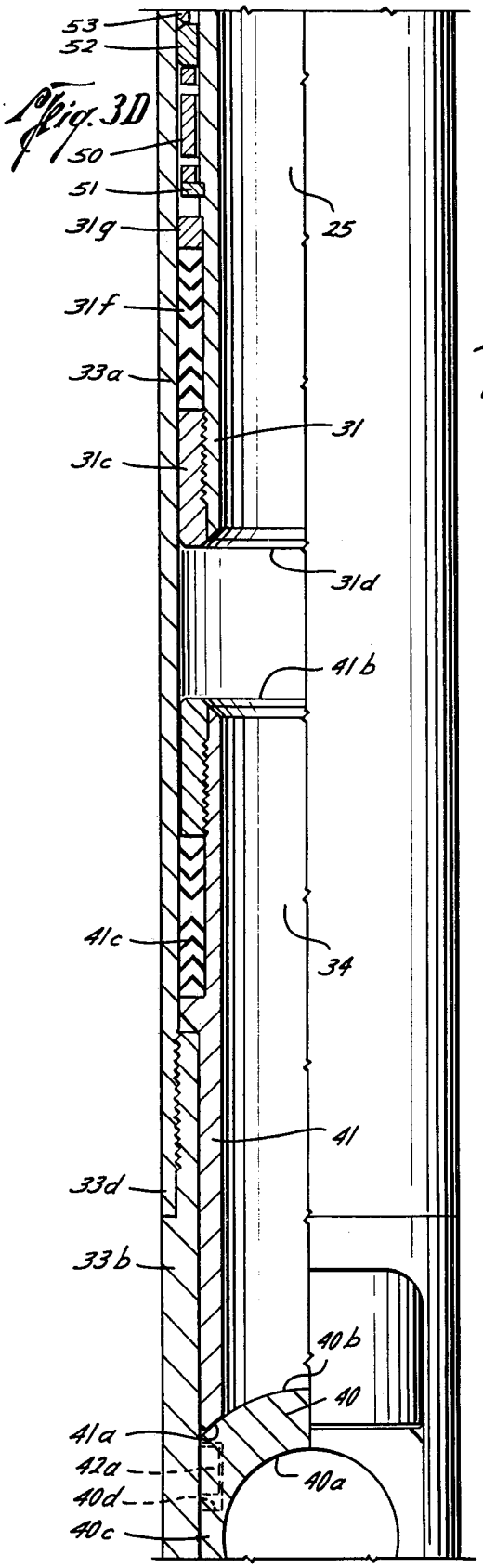

As illustrated in FIGS. 1C, 1D, 1E, and 1F, the slide means 33 for effecting movement of the bore closure means B includes three sleeve portions threadedly secured together to form a sleeve concentrically mounted with the tubular member 31 exterior and movable relative thereto between an upper position (FIGS. 1C, 1D, 1E, and 1F) and a lower position (FIGS. 3B, 3C, and 3D). The slide means 33 includes an upper sleeve portion 33*a* (FIGS. 1C and 1D) threadedly secured to the upper end of the intermediate sleeve portion 33*b* (FIG. 1E). The lower end of the sleeve 33*b* is threadedly secured to the upper end of the lower sleeve portion 33*c* (FIG. 1F). Rotation of the threaded sleeves 33*a*, 33*b*, and 33*c* is blocked by two threaded pin members 33*d* to prevent disengagement therebetween. The connected sleeves 33*a*, 33*b*, and 33*c* form a longitudinally-extending bore 34 which communicates with bore 25 to provide a flow passage through the flow control assembly F. The upper sleeve 33*a* has a stepped inner surface to form an upwardly facing annular shoulder surface 33*e* (FIG. 1C) while the inner surface of the lower sleeve 33*c* (FIG. 1F) is also stepped to provide an upwardly facing flat annular shoulder surface 33*f* and an upwardly-facing tapered annular shoulder surface 33*g*. A chevron packing ring 31*f* (FIG. 1E) is secured between the upper shoulder of the seal ring 31*c* and a ring packing keeper 31*g* for sealing between the tubular member 31 and the movable slide sleeve 33 to block passage of fluid therebetween.

The bore closure means B is movably disposed in the bore 34 of the slide 33 adjacent the middle sleeve portion 33*b* (FIG. 1E). The bore closure means B includes a rotatable ball-type valve 40 and a seat ring 41 located above the ball 40. The ball 40 has a bore 40*a* therethrough for enabling flow of fluid through the bore 34 when the ball 40 is in the bore aligned or opened position (FIG. 4B) and is rotatable to a transverse or closed position (FIG. 1E) blocking flow of fluid through the bore 34. The ball 40 includes an outer spherical surface 40*b* having a pair of parallel flat circular shaped surface portions 40*c*. Each of the parallel portions 40*c* has an elongated radially extending recess 40*d* formed therein for pivotally securing the ball 40 in the bore 34 and for imparting rotational movement to the ball 40 as will be set forth in greater detail hereinafter.

The seat ring 41 includes a lower annular seating surface 41*a* engaging the spherical surface 40*b* of the ball 40 for sealing thereto to block flow of fluid upwardly through the bore 34 of the slide 33 around the ball 40. The seat ring 41 is longitudinally movable relative to both the slide 33 and the tubular member 31 and has an upper annular shoulder 41*b* for engaging the lower annular shoulder 31*d* of the member 31*c* for limiting upward movement of the seat ring 41 and the ball 40. A packing ring 41*c* slidably seals between the inner surface of the slide 33 and the outer surface of the seat ring 41.

The flow control assembly F includes means for effecting movement of the bore closure B to the open position for enabling flow through the bore 25 comprising a pivot means 42 and an actuator means 43. The pivot means 42 (FIG. 1E) includes a pair of longitudinal axis aligned elongated pins 42*a* threadedly secured with the slide 33 at an eccentric position for extending into the corresponding recesses 40*d* in the flat surfaces 40*c* of the ball 40. Relative longitudinal movement between the ball 40 and the pins 42*a* will effect a cracking action to rotate the ball 40 to and from the open and closed positions. Upwardly movement of the ball 40 relative to the pins 42*a* rotates the ball 40 to the open position and movement of the ball 40 downwardly relatively to the pins 42*a* rotates the ball to a closed position.

The actuator means 43 includes a movable sleeve 44 concentrically disposed in the lower portion of the bore 34 of the slide 33 for engaging the ball 40 to impart an urging to effect upwardly longitudinal movement of the ball 40. The sleeve 44 has an arcuate upper annular shoulder 44*a* (FIG. 1E) for engaging the lower portion of the spherical outer surface 40*b* of the ball 40 to transmit the urging to the ball 40. The outer portion of the sleeve 44 has a collar 44*b* thereon (FIG. 1F) having a lower flat spring shoulder 44*c* and an annular tapered shoulder 44*d* engaging the shoulder 33*g* of the slide 33 to provide a lower stop for the sleeve 44. A spring means 44*e* is positioned between the shoulder 33*f* and the shoulder 44*c* for urging the sleeve 44 to move upwardly.

Means for effecting movement of the ball 40 to the closed position includes the slide 33, the pivot pins 42*a* and an urging means 50. The urging or spring means 50 for urging the slide 33 to move upwardly to effect closing rotation of the ball 40 (FIGS. 1D and 1E) is concentrically mounted in the annular area between the tubular member 31 and the slide 33. The lower end of the spring means 50 is mounted with the tubular member 31 by engagement with a snap ring spring keeper member 51 secured within a recess 31*h* in the outer surface of the tubular member 31. The upper end of the spring means 50 engages a lower annular shoulder 52*a* of a movable spring keeper ring 52, concentrically mounted on the tubular member 31. The keeper ring 52 has an upper shoulder 52*b* engagable by a lower shoulder 53*a* of a sleeve member 53 to transmit the urging of the spring 50 to the sleeve 53. The sleeve 53 (FIG. 1D) is longitudinally movable relative to the tubular member 31 and is partially guided in such movement by an upper inner surface 53*d* engaging the outer surface of the tubular member 31. A snap ring 54 secured with the tubular member 31 engages the sleeve 53 at an inner surface 53*b* to guide movement of the sleeve 53 and provide a lower limit movement stop to the sleeve 53 by engaging an annular shoulder 53*c*. The member 53 has an annular recess 53*e* formed in the upper outer surface 53*g* to receive a gapped spring detent ring 55 therein. When the ring 55 is aligned with an annular recess 33*h* formed on the slide portion 33*a*, the detent ring 55 expands outwardly to move into the recess 33*h* with an upper shoulder 55*a* of the ring 55 engaging a downwardly facing shoulder 33*i* of the annular recess 33*h* formed in the slide. The engagement of the shoulders 33*i* and 55*a* transmits the upward urging of the spring means 50 from the guide sleeve 53 to the slide 33. A port 33*j* extends through the slide 33 to enable disengagement of the slide 33 by forcing the detent ring 55 from the recess 33*h*. The guide member 53 has a pair of O-rings 53*f* mounted in recesses in the outer surface 53*g* to effect a seal to the slide 33 above and below the port 33*j* for preventing leakage of fluid therebetween. The spring 50 is made substantially stronger than spring 44*e* for overcoming the urging of spring 44*e* to compress the spring 44*e* and maintain the slide 33 in the upper position.

Figure 8:
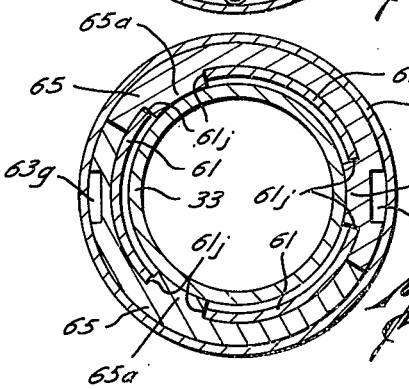

As illustrated in FIG. 1C, the flow control assembly F includes means for releasably locking the bore closure means B in the open position comprising the annular shoulder 33*e* of the slide 33, a plurality of detent balls 60 mounted with the flow control assembly F and a latch or locking sleeve 61. The locking sleeve 61 is concentrically mounted with the outer surface of the tubular member 31 and is longitudinally movably relative thereto and extends between an upper annular shoulder 61*a* and a lower flat annular shoulder 61*b*. The sleeve 61 has a constant diameter inner surface portion 61*c* for guiding the movement of the sleeve 61 and constant diameter outer surface portion 61*d* with an outwardly-extending annular collar 61*e* formed thereon. The collar 61*e* provides an upwardly-facing flat annular shoulder 61*f* engagable by a lower annular shoulder 71*t* of the piston means 71 for effecting downward movement of the sleeve 61. The sleeve 61 has an elongated aperture or slot 61*g* to receive an inwardly-extending finger 71*q* secured with the piston 71 for connecting and radially aligning the sleeve 61 with the piston 71, while enabling limited relative longitudinal movement therebetween. The sleeve 61 has a plurality of spaced windows 61*h* extending through the sleeve 61 above the collar 61*e* for a purpose to be set forth more fully hereinafter. The sleeve 61 has a plurality of window openings 61*i* beneath the collar 61*e* to enable inwardly-extending portions of a fixed ring member 74 extending through the sleeve 61 to secure the sleeve 74 with the tubular member 31 while enabling longitudinal movement of the sleeve 61. As illustrated in FIG. 8, the sleeve 61 is slotted to provide a plurality of three movement enabling clearance windows 61*j* through which a corresponding plurality of three inwardly-projecting fingers 65*a* of a fixed split ring 65 extend to secure the split ring 65 to the tubular member 31. The sleeve 61 has a plurality of window openings 61*k* and a corresponding plurality of open-ended slots 61*m* formed adjacent the lower end of the sleeve 61 to control movement of the detent balls 60. The downwardly-facing upper edge of the slot 61*m* and the upwardly-facing lower edge of the window 61*k* are tapered to force the balls 60 to move outwardly when they are engaged as will be set forth hereinbelow.

The locking sleeve 61 includes a biasing spring means 62 located above the sleeve 61 for urging the sleeve 61 to move downwardly. The spring is secured to the tubular member 31 by a ring-shaped spring keeper member 62*a* positioned above the spring 62. The member 62*a* is secured to the outer surface of the tubular member 31 by inwardly-extending fingers fitting within an annular recess 31*i* in the outer surface of the tubular member 31. The lower end of the spring 62 engages a movable spring keeper 62*b* concentrically mounted on the outer surface of the tubular member 31 above the sleeve 61 for imparting the urging of the spring 62 to the sleeve 61.

Mounted concentrically with and adjacent the lower exterior surface of the locking sleeve 61 is a sleeve member 63 which is fixed relative to the tubular member 31 to form a portion of the flow control assembly F (FIGS. 3B and 3C). The sleeve 63 is secured with the tubular member 31 by a lower annular shoulder 63*a* engaging an upper shoulder 64*a* of a ring member 64 having inwardly-extending finger portions 64*b* securing the ring member 64 in a recess 31*j* on the outer surface of the tubular member 31. Engagement of the sleeve 63 with the ring member 64 blocks downward movement of the sleeve 63 relative to the tubular member 31. The sleeve 63 is secured with the tubular member 31 against upward movement by engagement with a fixed split ring 65. The sleeve 63 is sealed to the slide 33 by an O-ring 63*c* positioned in the recess in the outer surface of a collar portion 63*d* to block passage of fluid therebetween. The sleeve 63 has a plurality of window openings 63*b* extending therethrough with a corresponding plurality of detent balls 60 positioned within the openings 63*b*. The diameter of the balls 60 is greater than the thickness of the sleeve 63 adjacent the opening 63*b* wherein the balls 60 protrude either inwardly or outwardly of the sleeve 63.

As illustrated in FIGS. 3B and 8, the sleeve 63 has a pair of upwardly-extending finger portions 63*g* which extend into corresponding recesses formed in the outer surface of the fixed split ring member 65. The inwardly-projecting fingers 65*a* of the split ring 65 extending through the windows 61*j* of the sleeve 61 thereby effect radial alignment of the plurality of window openings 63*b* in the fixed sleeve 63 and the windows 61*k* and slots 61*m* of the locking sleeve 61 for enabling the balls 60 to protrude inwardly. When the slide 33 is in the lower position enabling the ball 40 to rotate open, the shoulder 33*e* is positioned below the ball detents 60. This enables the spring 62 to urge the sleeve 61 downwardly to thereby wedge the balls 60 to protrude outwardly above the shoulder 33*e* with the tapered downwardly-facing shoulders of the slots 61*m*. The urging of the spring 62 will then move the sleeve 61 downwardly beside the balls 60 to lock the balls 60 with the outer surface 61*d* to protrude outwardly where they will engage the shoulder 33*e* to block the slide 33 from moving upwardly to rotate closed the ball 40. Subsequent longitudinal movement of the locking sleeve 61 to align the windows 61*k* or the slots 61*m* with the detent balls 60 will enable the spring 50 urging on the slide 33 to wedge the released balls 60 to move inwardly and move the slide 33 to the upper position effecting closing rotation of the ball 40.

The locking sleeve 61 is operably connected with the piston 71 to effect longitudinal movement of the sleeve 61 to release the locking means in response to the well pressure urging movement of the piston 71. As illustrated in FIG. 1C, the finger member 71*q* also radially aligns the windows 61*h* in the locking sleeve 61 and a corresponding plurality of tapered edge window openings 71*r* in the lower sleeve 71*b* of the plunger 71. A corresponding plurality of detent balls 73 having a greater diameter than the wall thickness of the piston 71 are located in the plurality of windows 71*r* to protrude inwardly or outwardly of the piston 71. The lower annular shoulder 71*t* of the piston 71 is adapted to engage the upwardly-facing shoulder 61*f* for urging the locking sleeve 61 to move downwardly in response to pressures urging on the piston 71 to align the windows 61*k* with the balls 60 to release the slide 33.

A latch slide or detent connecting means 72 (FIG. 1C) is a longitudinally movable sleeve for controlling movement of the detent balls 73. The upper movement limit stop for the member 72 is provided by engagement with an upper stop ring 74 secured to the tubular member 31 by inwardly projecting fingers 74*a* extending through the slots 61*i* in the sleeve 61 to the tubular member 31. The member 72 has a stepped inner surface 72*a* having an inwardly projecting collar 72*b* to provide an upwardly facing annular shoulder surface 72*c* for engaging the lower shoulder of the stop ring 74. The detent connecting means includes a spring means 72*d* concentrically mounted with tubular member 31 between a downwardly facing annular shoulder 72*e* of the collar 72*b* and the fixed split ring 65 for normally biasing the latch sleeve 72 to move upwardly to the position illustrated in FIG. 1C. Engagement of the detent ball 73 with a tapered annular shoulder 72*f* on the inner surface 72*a* will enable the piston 71 to move the latch slide 72 downwardly with the piston 71 until the detent balls 73 are aligned with the plurality of windows 61*h* in the sleeve 61 at which time the tapered annular shoulder 72*f* will cam or wedge the balls 73 inwardly into the windows 61*h* enabling the spring means 72*d* to move the latch sleeve 72 upwardly. The upwardly movement of the latch sleeve 72 locks the balls 73 in the windows 61*h* of the sleeve 61 for connecting the locking sleeve 61 with the piston 71 to move the locking sleeve 61 with the piston 71 as the piston 71 moves in response to the well pressure.

Figure 10:
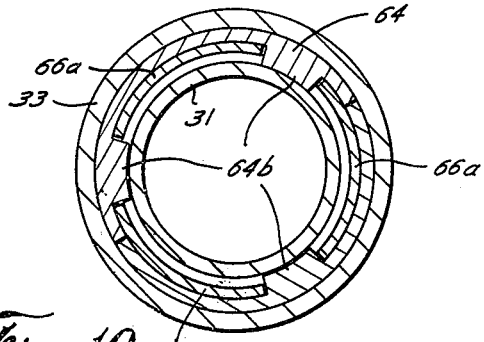
FIG. 10 is a view taken along line 10—10 of FIG. 1D.

Concentrically mounted with the outer surface of the tubular member 31 below the sleeve 61 in a balance means or means for delaying the valve from closing when the pressure in the bore of the tubing varies from the preselected pressure until the pressure varies to a predetermined pressure less than the preselected pressure. As illustrated in FIGS. 2C and 10, the balance means includes a movable ring member 66 having a plurality of upwardly-extending finger portions 66*a* positioned between the inwardly-extending fingers 64*b* of the fixed ring 64 for providing movement enabling clearance to the ring 66 as well as an upper movement limit stop. The upwardly-extending fingers 66*a* provide an upwardly-facing annular shoulder 66*b* adapted to engage the downwardly-facing slotted annular shoulder 61*b* of the locking sleeve 61. The ring 66 is longitudinally movable between an upper position (FIG. 1C) and a lower position (FIG. 2C). It will also be appreciated that the fixed ring 64 also provides a lower movement limit stop for the locking sleeve 61. The means for delaying the valve from closing includes a spring means 67 for urging the balanced member 66 normally to move upwardly which is concentrically mounted with the tubular member 31 beneath the balanced member 66. The spring means 67 includes a fixed spring retainer member 67*a* secured to the tubular member 31 and an adjustment ring 67*b* threadedly secured to the keeper 67*a*. Rotation of the adjustment ring 67*b* relative to the keeper 67*a* compresses the spring means 67 to enable adjustment of the upwardly-urging force imparted to the ring 66 for delaying downwardly movement of the locking sleeve 61. A threaded keeper pin 67*c* blocks rotation of the adjustment member 67*b* relative to the keeper 67*a* after the urging or upward force of the spring 67 has been set to a predetermined pressure urging.

The flow control assembly F also includes a means for equalizing the urging of the well pressure on the flow control housing to provide a larger flow passage through the bore of the well tubing adjacent the flow control assembly F by reducing the thickness of the flow control assembly F. The means for equalizing the urging of the well pressure includes a balance piston 81 and a balance chamber 82. The balance piston 81 (FIG. 1B) is a ring-shaped member positioned between the tubular member 31 and the surface 71*n* of the piston 71 adjacent the shoulder 71*d* and is longitudinally movable relative to both the piston 71 and the tubular member 31 in response to pressure urgings thereon. The balance piston 81 is sealed by a pair of O-rings 81*a* and 81*b* to the inner surface 71*n* of the plunger 71 and the outer surface of the tubular member 31, respectively, to block leakage of fluid about the balance piston 82. Sealing about the balance piston 81 provides an upwardly-facing pressure responsive annular surface 81*c* and a downwardly-facing pressure responsive annular surface 81*d* which effect movement of the balance piston 81 in response to the pressure differential urging. The balance chamber 82 forms well pressure equalizing surfaces in the flow control assembly F and is defined by the outer surface of the tubular member 31 including the upper shoulder of the seal ring 31*c* to packing 31*f* (FIG. 1E), a portion of the inner surface of the slide 33 (FIGS. 1C and 1D), the surface portions of the sleeve 63 between the O-rings 63*c* and 63*e*, the inner surface of the latch slide 73, the lower portion of the piston 71 inside the O-ring 71*s* and the lower shoulder of the balance piston 81. By filling the chamber 82 with a liquid, such as oil, the pressure of the oil in the chamber 82 will be maintained equal to the pressure in the bore of the tubing communicated through the port 71*p* to the surface by an equalizing movement of the balance piston 81 to effect an equal pressure urging by the oil in the chamber 82 on the surface 81*d*. The oil in the chamber 82 provides a clean environment for the working parts of the flow control assembly F located in the chamber 82 as well as eliminating stresses caused by well pressure thereby enabling the use of thinner wall thickness sleeves. Only the tubular member 31, the seat ring 41, and the ball 40 need be of sufficient wall thickness to withstand the pressure in the bore of the tubing.

In the use and operation of the present invention the well shut-in pressure, the normal well flowing pressure, and wide open or full bore well flowing pressure at the location where the tool S is to be secured in the production tubing is first determined. The normal well flowing pressure is always less than the shut-in pressure and will be greater than the full bore flowing pressure. The magnitude of these pressures and their difference will vary from well to well. As an example for purposes of this disclosure, the well will have a normal subsurface flowing pressure of 2500 psi, a subsurface shut-in pressure of 3000 psi and a full bore flowing pressure of 2200 psi. An intermediate pressure between the normal flowing pressure and the shut-in pressure is then selected as the well preselected pressure. The predetermined pressure may then be chosen in the pressure range between the well normal flowing pressure and the well full bore flowing pressure. For this disclosure the preselected well pressure will be 2750 psi and the full bore pressure of 2200 psi becomes the predetermined well pressure for setting the delaying spring 67.

The upward urging force of the balance spring means 67 is then adjusted to enable the piston 71 to move the sleeve 61 downwardly sufficiently to align the windows 61*k* with the detent balls 60 when the pressure in the well decreases below the normal flowing pressure to the predetermined wide open flowing pressure.

The net movement effecting urging force on the piston 71 will be the difference between the charged pressure downwardly urging on the surface 71*g* and the pressure in the bore of the tubing upwardly urging on the surface 71*d* multiplied by the effective surface area. For example, if the effective surface area of the surface 71*g* and 71*d* is a half inch, the net downwardly urging force on the plunger 71 at the normal flowing cell pressure of 2500 psi with a charged pressure in the chamber 37 of 2750 psi would be 250 psi times 0.5 square inches or 125 pounds. The engagement of the detent balls 60 with the upper surface of the slots 61*m* in the lower portion of the sleeve 61 will limit downward movement of the sleeve 61 and the plunger 71 at the normal well flowing pressure. The distance the sleeve 61 must move downwardly from this position to engage the shoulder 66*b* of the balance member 66*a* in the upper position which enables the sleeve 61 to latch the balls 60 outwardly to lock the slide 33 in the lower portion is ⅜ of an inch. An additional ⅜ inch downward travel of the sleeve 61 amd engaged balance member 66 is needed to align the windows 61*k* with the detent balls 60 to release the slide 33 when the piston 71 urges downwardly thereon. The net downward pressure urging force on the piston 71 at the predetermined full bore flowing pressure of 2200 psi will be 2750 psi less 2200 psi or 550 psi times 0.5 square inch equaling 275 pounds. The additional downward pressure or force on the piston 71 between the normal and full bore flowing pressure is then determined, which, for this example, is 275 pounds less 125 pounds or 150 pounds.

The spring constant of the spring 67 is known and the spring 67 is selected depending upon the determined urging force difference between the full bore pressure and the normal flowing pressure on the plunger 71. The spring 67 is first preloaded by compressing the spring to provide a 125-pound upwardly-urging to the balance member 64 to equalize the 125-pound net downwardly urging or the plunger 71 imparted to the sleeve 61 resulting from the normal flowing pressure of 2500 psi urging on the plunger 71. Preloading enables the sleeve 61 to move to engage the balance member 66 without moving the balance member 66 downwardly at normal well flowing pressure to effect a positive latch of the detent balls 60 by the sleeve 61. To establish the preload on the spring 67, the adjustment ring 67*b* is moved upwardly by rotating the adjustment ring 67*b* relative to the fixed spring keeper 67*a* to compress the spring 67*b* a calculated distance to provide the desired loadings. As the well pressure decreases from the normal flowing pressure to the predetermined full bore flowing pressure, the net downwardly force difference on the plunger 71 increases by 150 pounds. To effect a release of the detent balls 60 to rotate the ball 40 closed at the predetermined well pressure, the spring 67 is selected to compress a distance of ⅜ of an inch, to align the windows 61*k* with the detent balls 60 when the additional downwardly-urging force of 150 pounds acts thereon. To provide such movement, a spring 67 having a spring constant of 400 pounds per inch is selected for installation in the tool. The preload compression on the spring 67 of 125 pounds would require a five-sixteenth of an inch compression of the spring 67. The tool is then assembled and taken to the job site in the condition illustrated in FIGS. 1A, 1B, 1C, 1D, 1E, and 1F.

At the well site, compressed gas, preferably nitrogen to prevent deterioration to the rubber diaphragm 34, is injected or charged into the system at port 35*a* to pressure the chamber 37 to the desired pressure. The flapper member 35*d* moves aside to enable flow through the port 34*f* into the chamber 37, but moves to cover the port 34*f* to block flow from the chamber 37 through the port 34*f* to maintain the preselected pressure in the chamber 37. Since the pressure responsive annular surfaces 71*d* and 71*g* have preferably the same effective surface area the pressure charged into the chamber 37 is the preselected well pressure. One skilled in the art may vary the size of the effective surface areas 71*d* and 71*g* to enable a different pressure to be charged into the chamber 37 to effect the desired downwardly reference urging on the piston 71.

Figures 2A, 2B:
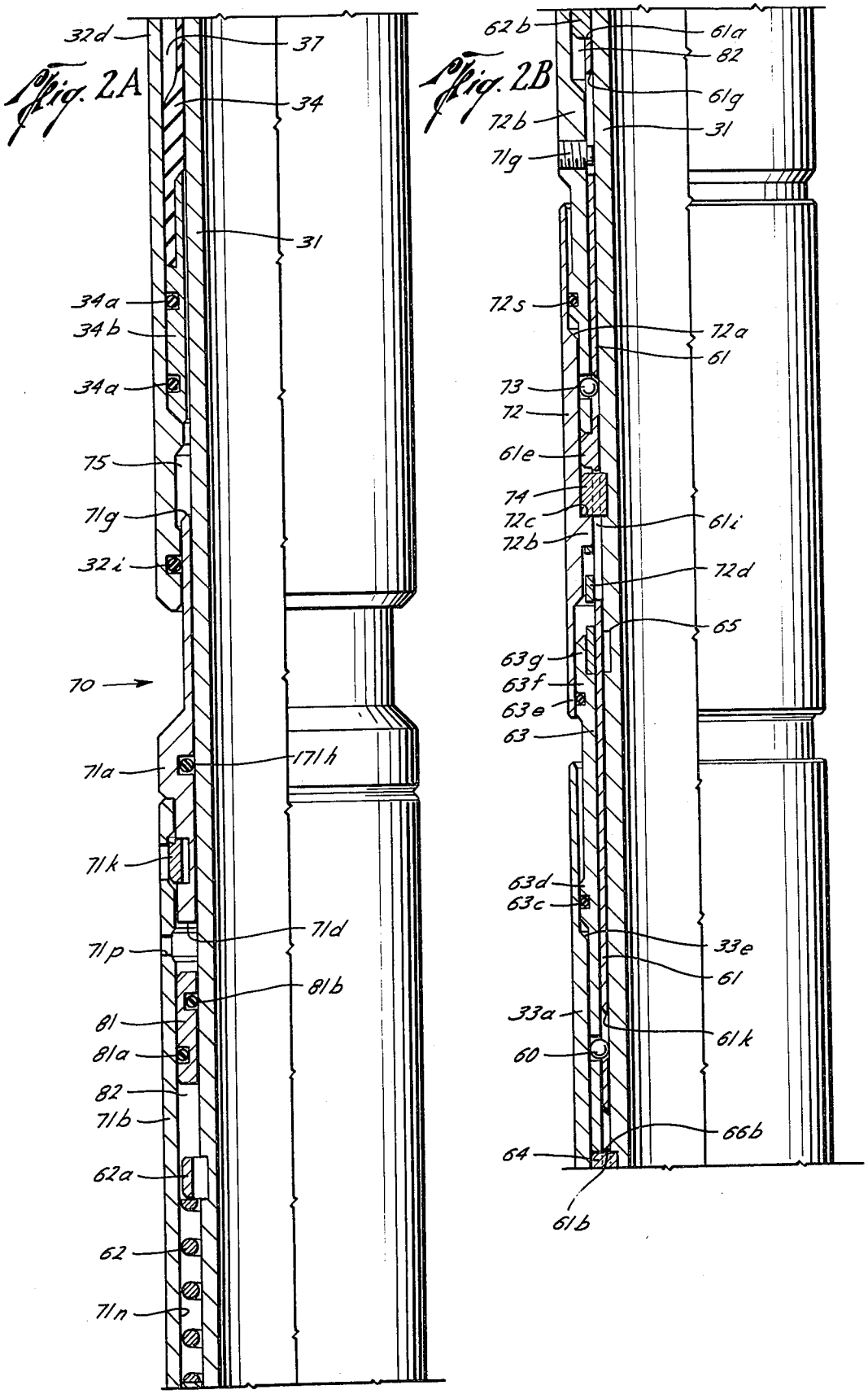
FIGS. 2A, 2B, and 2C are views similar to FIGS. 1B and 1C with the preselected pressure in the reference chamber.
Figure 2C:
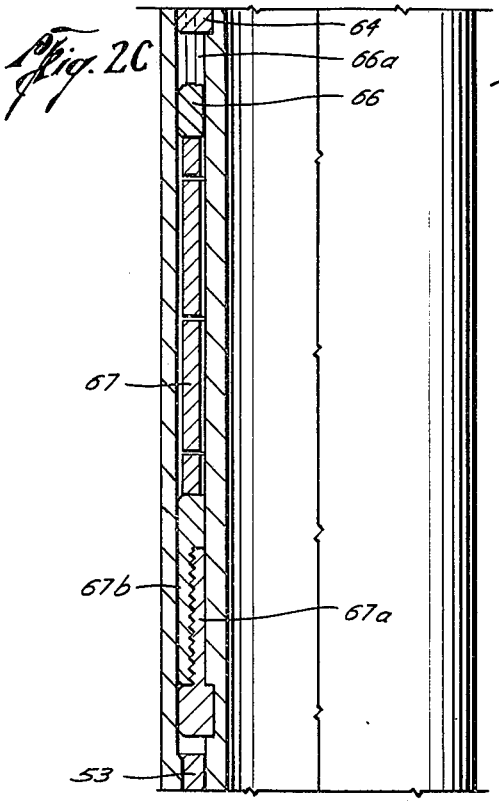
Figures 6A, 6B:
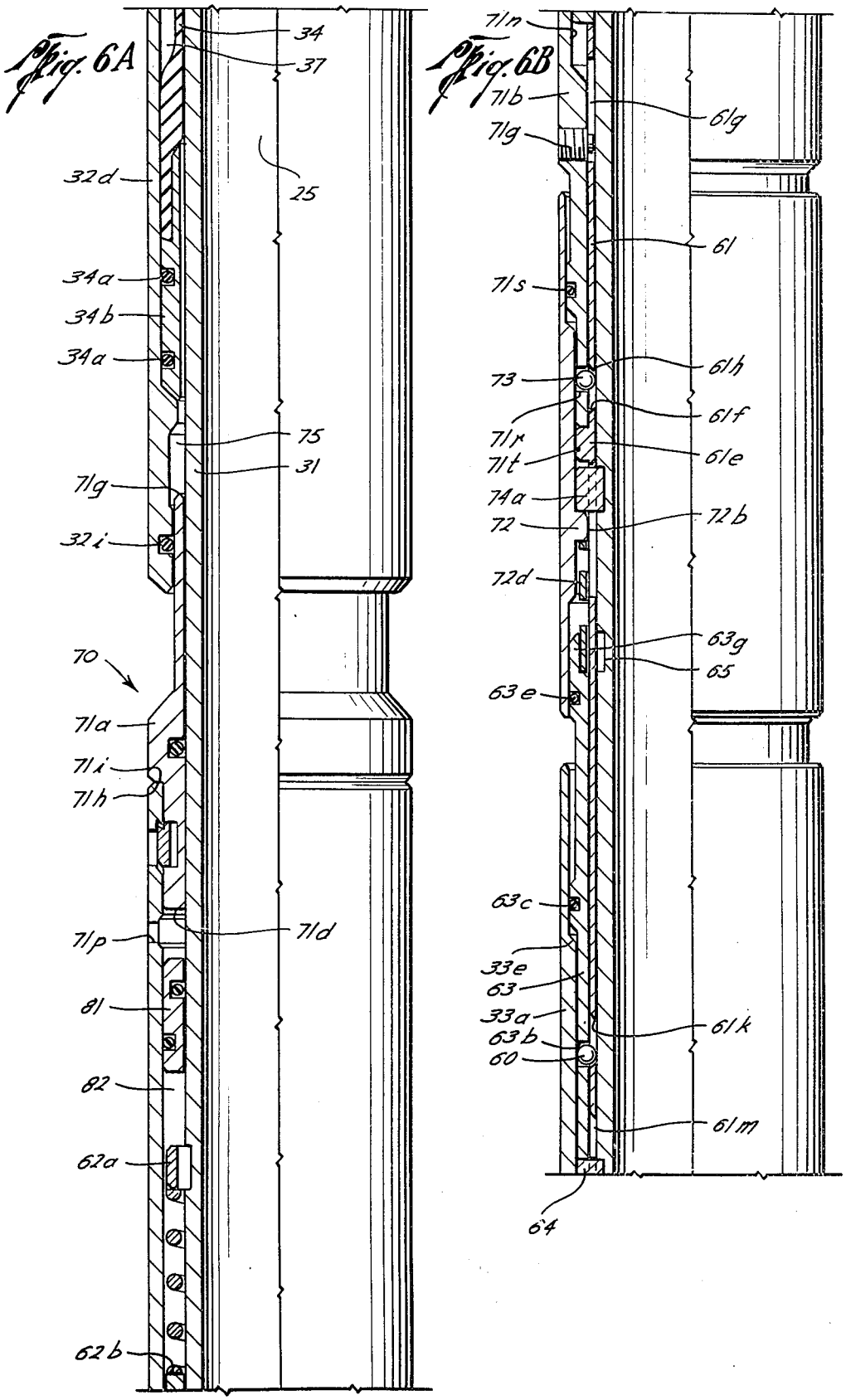
FIGS. 6A and 6B are side views similar to FIGS. 5A and 5B illustrating the valve closed by decreased pressure in the well.

When the pressure charge has been established in the chamber 37 and the supply of nitrogen is disconnected, the tool S is in the condition illustrated in FIGS. 2A, 2B, and 2C. The gas pressure in the chamber 37 moves the diaphragm 34 inwardly to fill the portion of the chamber 75, not filled with oil. The pressure of the gas in the chamber 37 is then transmitted through the oil in the chamber 75 to the piston surface 71*g* for urging the piston 71 to move downwardly. Because the urging of the atmosphere pressure on shoulder 71*d* is much less than the charged pressure, the piston 71 moves downwardly from the upper or retracted position (FIGS. 1B and 1C) to the lower or extended position in FIGS. 6A and 6B. The annular shoulder 71*t* of the piston 71 engages the shoulder 61*f* of the sleeve 61 to move the sleeve 61 downwardly to engage the upper shoulder 66*b* of the ring 66. Since the pressure differential of the piston 71 is greater than 150 pounds, the piston 71 will overcome the upwardly urging of the balance spring 67 to move the ring 66 downwardly.

As the piston 71 moves downwardly, the detent balls 73 mounted thereon engage the annular shoulder 72*f* for moving the latch sleeve 72 downwardly with the plunger 71. The downward movement of the latch sleeve 72 continues until the plurality of balls 73 align with the plurality of windows 61*h* in the latch sleeve 61. The upward urging of the spring 72*d* then wedges the balls 73 inwardly into the windows 61*h* of the locking sleeve 61. Such movement of the balls 73 unlocks or releases the latch sleeve 72 from the plunger 71 and enables the spring means 72*d* to move the latch sleeve 72 upwardly to the position illustrated in FIG. 2B with the balls 73 locked in the windows 61*h* of the sleeve 61.

The tool 20 is then secured beneath and sealed to the tubular mandrel by engagement with threads 31*a*. The mandrel is then connected to a wire line running tool and the entire assembly is lowered down the bore of the production tubing to the subsurface position for securing the well tool S. The mandrel is then secured in the bore of the tubing and the wire line running tool retrieved as is well known in the art. The mandrel is also provided with means for sealing between the outer surface of the mandrel and the inner surface of the bore of the tubing of directing the flow through the bore of the tubular mandrel as is also well known in the art.

With the well surface control valves closed, the well shut-in pressure is communicated through the port 71*p* to the pressure responsive surface 71*d* to urge the piston 71 to move upwardly. The well pressure communicated through the port 71*d* also urges on the upper shoulder 18*c* of the balance piston 81 to urge the balance piston downwardly to maintain the oil pressure in the expansible chamber 82 equal to the well shut-in pressure. This eliminates any pressure differential across the slide 33, the sleeve 63, the latch slide 72 or the piston 71 which would damage, create stresses, or otherwise interfere with their operation.

Figure 5A:
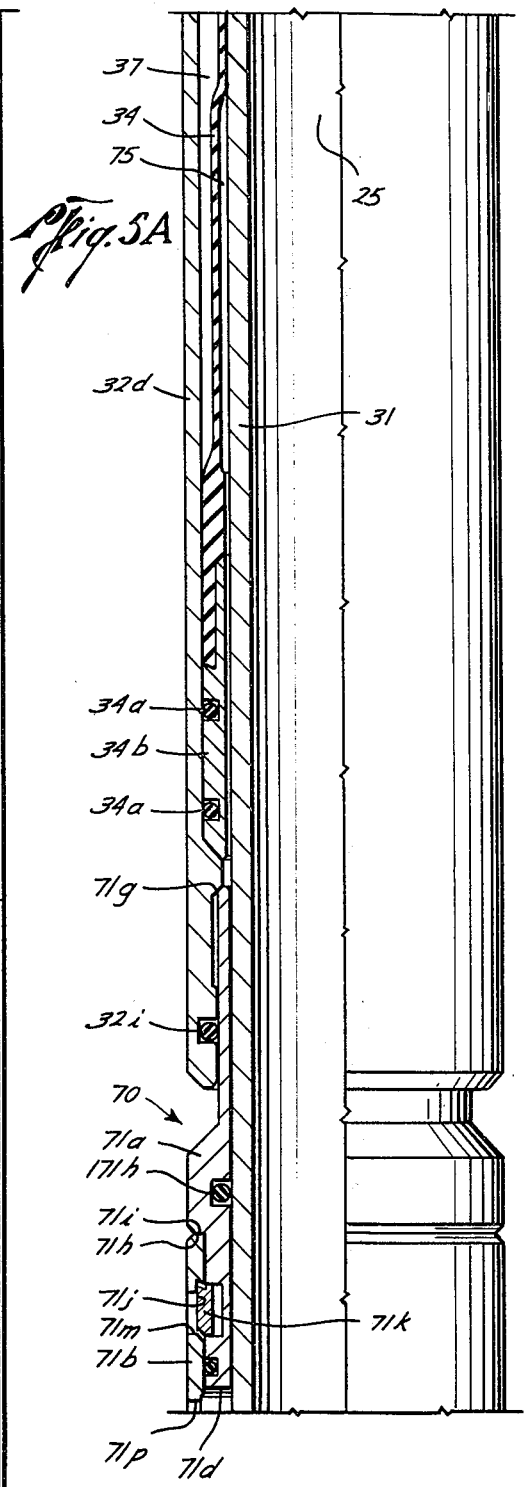
FIGS. 5A, 5B, and 5C are side views illustrating the valve closed by increased pressure in the well.
Figure 5B:
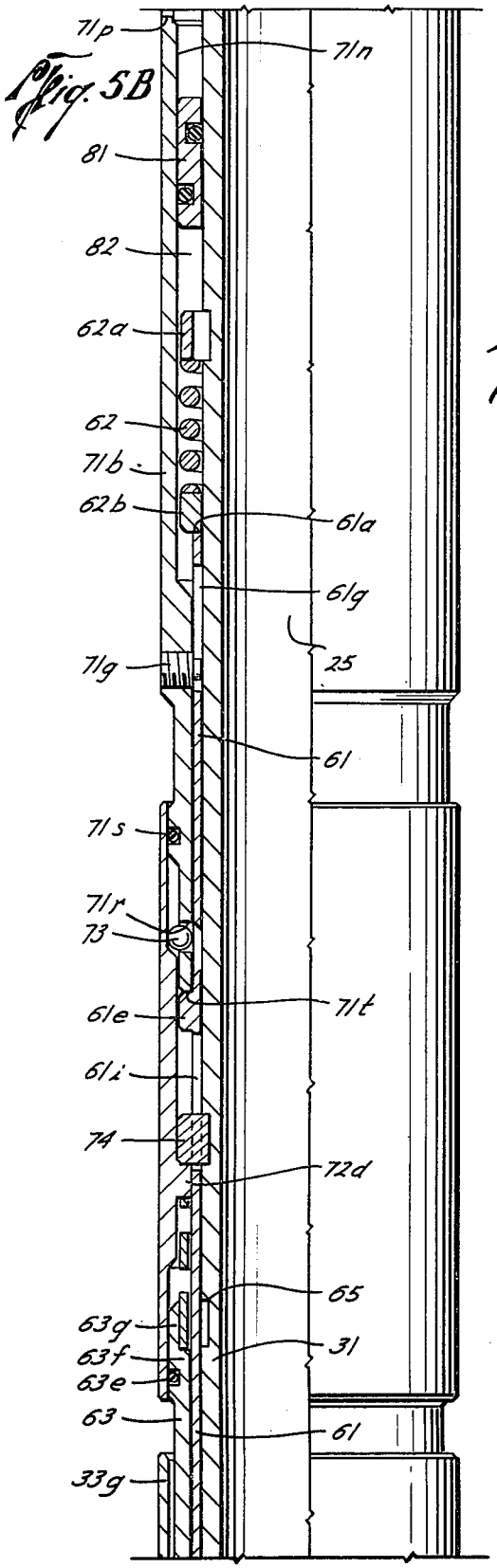
Figure 5C:
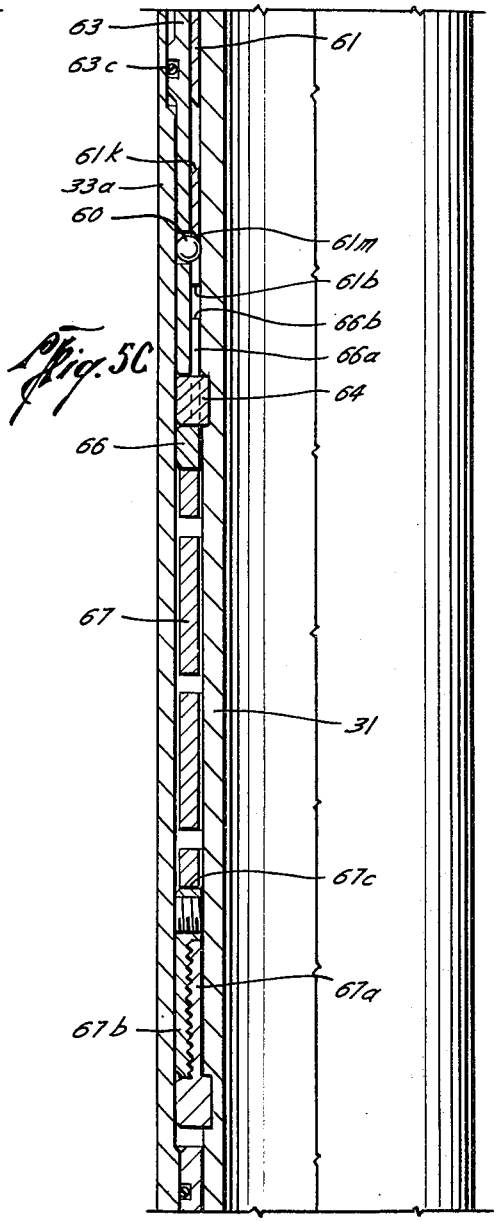

Because the charged pressure in the chamber 37 urging downwardly on the piston 71 is less than the shut-in pressure urging upwardly on the shoulder 71*d* of the piston 71, the piston 71 moves upwardly to the position illustrated in FIGS. 5A, 5B, and 5C. The upward movement of the piston 71 also moves the sleeve 61 upwardly by engagement of the locked balls 73 with the upper edge of the window 61*h* until the balls 73 are aligned with the inner surface portion of the sleeve 72 above the annular shoulder 72*f*. The downward biasing of the spring 62 imparted to the sleeve 61 will then wedge the balls 73 outwardly above the shoulder 72*f* to release the locking sleeve 61 from the piston 71. This enables the sleeve 61 to move downwardly until the upper edge of the slots 61*m* engage the balls 60 which limits further downward movement of sleeve 61 with the balls 73 remaining with the sleeve 72 above the shoulder 72*f* as illustrated in FIG. 3B.

To rotate the ball 40 to the aligned position enabling fluid flow enough the bore of the tubing, a pump or other pressure generating means is connected to the bore of the tubing at the surface. The pressure in the bore of the tubing above the ball 40 is then increased until it is greater than the shut-in pressure of the well. The increased pressure produces a pressure differential across the ball 40 and the seat ring 41 to produce a downward urging force which overcomes the upward urging of the spring 50 to move the ball 40, the seat ring 41 and the slide 33 downwardly relative to the tubular member 31 (FIG. 3D). The downward acting force produced by the pressure urging on the ball 40 and the seat ring 41 is transmitted through the sleeve 44 to the slide 33 at engaged annular shoulders 44*d* and 33*g* (FIG. 1F).

As illustrated in FIGS. 3B and 3C, the downward movement of slide 33 moves the annular shoulder 33*e* below the plurality of balls 60 located in the window openings 63*b* of the sleeve 63. When the shoulder 33*e* of the slide 33 is below the balls 60 the biasing of the spring 62 urging the latch sleeve 61 downwardly wedges or forces the engaged balls 60 outwardly above the shoulder 33*e* with the tapered upper edge of the slots 61*m*. The latch 61 continues to move downwardly for ⅜ of an inch until the lower annular shoulder 61*b* engages the upper shoulder 66*b* of the balance member 66 to latch the balls 60. With the balls 60 locked above the shoulder 33*e*, the slide 33 is blocked from moving upwardly by the urging of spring 50 by engagement of the shoulder 33*e* of the slide 33 with the balls 60 positioned in the window 63*b*. As illustrated in FIG. 3A, the ball 40 is still closed and the piston 71 has the same well shut-in pressure and preselected charged reservoir pressure acting thereon and has not moved even though the pressure in the bore of the tubing above the ball 40 has been increased. The balance piston 81, to maintain a constant pressure in the chamber 82 equal to the shut-in pressure, moves downwardly to adjust for the change in volume of the chamber 82 by movement of the slide 33 downwardly to the lower position.

Figure 4A:
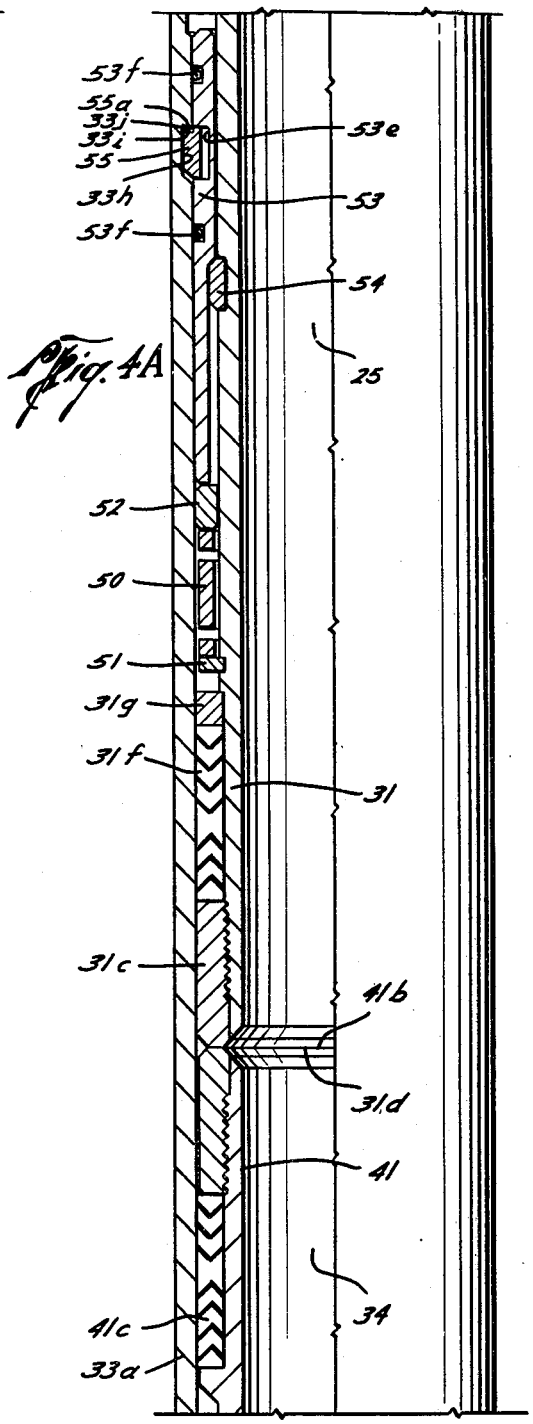
FIGS. 4A, and 4B are views similar to FIGS. 3A and 3B illustrating the valve in the open position.
Figure 4B:
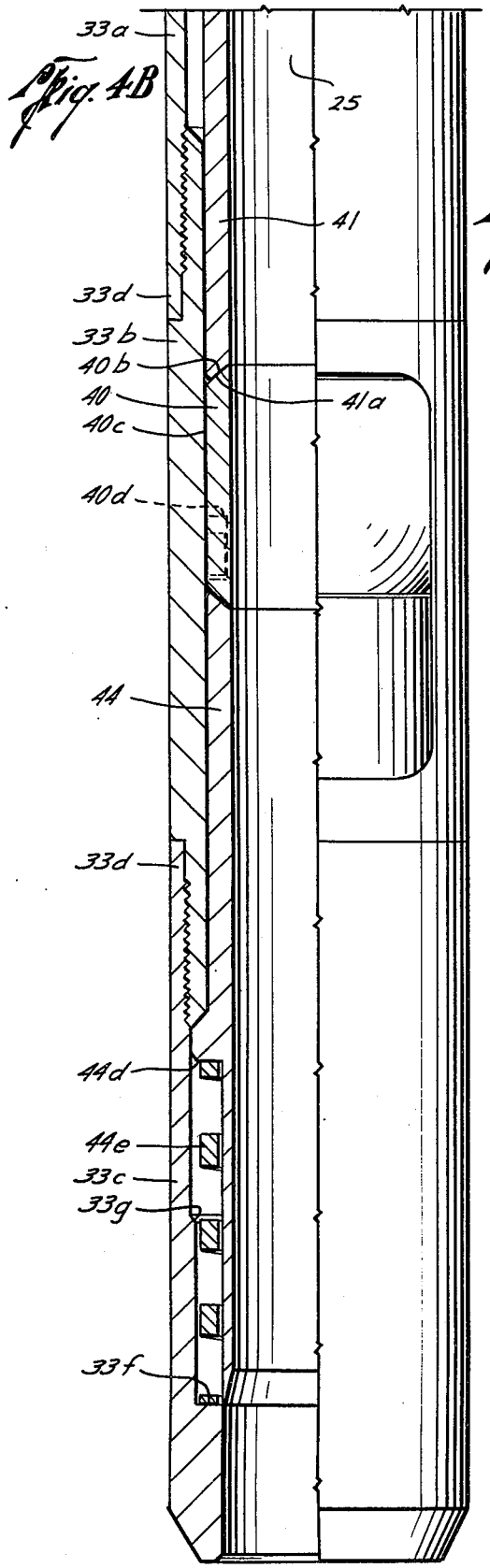

After locking the slide 33 in the lower position with the balls 60, the ball 40 is rotated to the open or aligned position, illustrated in FIG. 4B by venting or otherwise decreasing the pressure in the bore of the tubing above the ball 40. The reduced pressure urging downwardly on the ball 40 and the seat ring 41 enables the urging of the spring 44*e* to move the sleeve 44 upwardly. The upward movement of the sleeve 44 also imparts an upward movement to the engage ball 40 and seat ring 41 relative to slide 33.

Relative longitudinal movement of ball 40 to the slide 33 also moves the ball 40 relative to the pivot pins 43*a* secured to the slide 33. The upward movement of the ball 40 imparts a 90° rotation to the ball 40 for rotating the ball 40 to the aligned position for enabling flow of fluid through the bore of the tubing. Reference is made to my copending applications, Ser. No. 131,628, filed Apr. 6, 1871, and related application, Ser. No. 214,734, filed Jan. 3, 1972, and now U.S. Pat. No. 3,821,962 which illustrates in greater detail the relationship of the eccentric pins 43*a* and the ball 40 in rotating the ball 40 to the aligned position by the upward movement relative to the pins 43*a* from the closed position. The sleeve 44, the rotating ball 40 and the seat ring 41 move upwardly until the upper annular shoulder 41*b* of the seat ring 41 engages the lower shoulder 31*d* of the fixed member 31*c*.

With the ball 40 rotated to the aligned or open position, hydrocarbons and the like in the producing formation flow through the bore of the production tubing and the bore 25 of the well tool 20 to the surface. Valves on the well surface control equipment are normally used to control the flow of the fluid through the bore of the tubing as is well known. When flow through the bore of the tubing is established, the well pressure in the bore of the tubing is reduced to the normal flowing well pressure which is less than the preselected well pressure established in the reservoir 37. With the well flowing pressure communicated through the port 71*p* to the shoulder surface 71*d* of the piston 71 less than the preselected pressure in the reservoir 37 urging on the shoulder surface 71*q* the piston 71 is moved downwardly. The downward movement of the piston 71 to the extended position also moves the latch slide 72 downwardly through engagement of the balls 73 with the shoulder 72*q*.

The latch sleeve 72 continues to move downwardly with the piston 71 until the detent balls 73 are aligned with windows 61*h* in the latch sleeve 61. When aligned with the windows 61*h* the lower tapered annular shoulder 72*f* wedges the balls 73 inwardly into the windows 61*h* by the urging of the spring means 72*d* to disengage the balls from the shoulder 72*f* and enable the spring 72*d* to move the released latch sleeve 72 upwardly. The upward movement of the latch sleeve 72 by the spring 72*d* locks the balls 73 in the windows 61*h* of the locking sleeve 61 to operably connect the plunger 71 and the locking sleeve 61.

When the well pressure in the bore of the tubing varies from the preselected well pressure the piston 71 will move to rotate the ball 40 closed. Should the well pressure increase as when the surface well control valve is closed, the greater shut-in pressure will urge on the shoulder 71*d* of the piston 71 to overcome the downwardly urging of the preselected pressure in chamber 37 to move the plunger upwardly. The upward movement of the plunger 71 will engage the plurality of detent balls 73 with the upper surface of the windows 61*h* to overcome the downwardly urging imparted by the spring 62 to move the locking sleeve 61 upwardly. The upward movement of the sleeve 61 moves the slots 61*m* on the lower portion of the sleeve 61 to align with the balls 60, to unlock the detent balls 60 and enable their movement from the annular shoulder 33*e*. With the detent balls 60 no longer locked, the upwardly movement imparted by the urging of the spring 50 wedges the balls 60 into the slots 61*m* and moves the slide 33 to the upper position.

The upper shoulder 41*b* of the seat ring 41 engaging the member 31*c* blocks upward movement of the ball 40 with the slide 33. This enables the eccentric pins 43*a* secured to the slide 33 to move upwardly relative to the ball 40 to rotate the ball 40 90° from the open position to the closed position. The movement of the ball 40 to the closed position from the open position is also illustrated in greater detail in my copending applications referred to hereinabove.

With the ball 40 in the closed position, the flow of fluid in the bore of the tubing is blocked at both the subsurface location and at the well surface. Should the surface located control equipment be subsequently destroyed, damaged or otherwise impaired by fire or the like, the well tool S will continue to block flow through the bore of the tubing to prevent a well blowout. When it is desired to produce the well again, it is only necessary to sequentially increase and then decrease the pressure in the bore of the tubing above the ball 40 to crank open the ball 40 to enable flow. A subsequent decrease to the normal well flowing pressure will again cock the piston 71 to enable imparting closing rotation to the ball 40 when the well pressure varies from the preselected pressure.

A decrease in well pressure below the preselected well pressure will enable the piston 71 to move the engaged locking sleeve 61 downwardly to align the window 61*k* with the locked detent balls 60 to release the slide 33 and close the ball 40. Since the normal well flowing pressure is less than the pressure in the chamber 37 urging on the piston 71, the piston 71 will move downwardly to operably connect with the locking sleeve 61 by engagement of the detent balls 73. The lower annular shoulder 71*t* of the piston 71 is also brought into engagement with the shoulder 61*f* of the locking sleeve 61 for imparting the downwardly urging of the piston 71 to the sleeve 61. The balance ring 66 will engage the sleeve 61 to block further downward movement of the engaged locking sleeve 61 because of the upward urging imparted to the balance member 66 by the spring means 67. By setting the preloaded upwardly-urging force of the spring 67 with the keeper members 67*a* and 67*b*, the upward urging of the normal well flowing pressure on the piston 71 and the upward urging of the spring 67 is equal to the downward urging of the pressure in the chamber 37 and the piston 71 and locking sleeve 61 will remain stationary as the well pressure varies from the preselected pressure to the normal flowing pressure. The ring member 64 secured with the tubular member 31 limits upward movement of the balance member 66 to maintain the locking sleeve 61 in the detent ball 60 locking position illustrated in FIGS. 3B and 3C.

As the well pressure continues to decrease below the normal well flowing pressure, the well pressure urging upwardly on the shoulder 71*d* for opposing the urging of the preselected pressure in the chamber 37 decreases. The increased downwardly urging on the piston 71 is imparted to the locking sleeve 61 by engagement of the annular shoulder 72*t* and the upward facing shoulder 61*f* of the locking sleeve 61. The downward urging of the piston 71 will be opposed by the upwardly biasing spring 67 without movement of the piston 71 until the preload set by adjusting members 67*b* and 67*a* on the spring 67 has been overcome. Additional piston movement delaying urging by the spring 67 result from compression of the spring 67 and downward movement of the balance member 66, the locking sleeve 61, and the piston 71 (FIG. 2C). When the locking sleeve 61 has moved downwardly a sufficient distance to align the plurality of windows 61*k* with the detent balls 60, the balls 60 are free to move inwardly and out of locking engagement with the annular shoulder 33*e* of the slide 33. The upward urging of the strong spring 50 then wedges or forces the balls 60 inwardly with the tapered annular surface 33*e* and moves the slide 33 upwardly to the postion illustrated in FIG. 6B. The upwardly movement of the slide 33 rotates the ball 40 to the closed or transverse position as set forth hereinabove. By selecting a spring 67 having a spring constant to provide the desired movement and by adjusting the preload on spring 67, the predetermined pressure below the normal well flowing pressure at which the ball 40 is rotated closed may be precisely and accurately determined. This feature is a significant advantage in a well having a high allowable normal flow.

In subsequently opening the ball 40 by increasing the pressure in the bore of the tubing above the ball 40, the annular shoulder 33*e* is again moved below the balls 60 for enabling the balls 60 to move outwardly. The upward urging of the stronger spring 67 on the balancing member 66 will overcome the downward urging of the spring 62 on the locking sleeve 61 to urge the locking sleeve 61 to move upwardly to the locking position illustrated in FIG. 3B, for locking the slide 33 in the lower position.

If the well tool S malfunctions, the well tool S and connected mandrel 21 may be retrieved back to the surface with a wire-line retrieval tool. A properly-operating well tool S may then be run in the bore of the tubing T, without the need to kill the well and pull the tubing T to replace the safety valve. While the preferred embodiment of the present invention is a wire-line run and retrieved safety valve, the invention may be employed without that feature by simply securing the tool S in the bore of a well tubing joint which would then be included in the flow control housing F. The tubing joint thus forming a portion of the flow control assembly F would then be connected in the well tubing string at the desired location.

The foregoing disclosure and description of the invention are illustrative and explanatory thereof, and various changes in the size, shape, and materials, as well as in the details of the illustrated construction, may be made without departing from the spirit of the invention.

What is claimed is:

1. A method of controlling operation of a well pressure safety valve adapted to be located at a subsurface location in a well tubing for controlling flow of well fluids to the surface through the bore of the well tubing including the steps of:

establishing a preselected ambient well fluid pressure for sensing by the safety valve to enable flow through the bore of the well tubing to the surface;

sensing with the safety valve both increasing and decreasing pressure changes in the well fluid pressure in the well tubing from the established preselected well fluid pressure for effecting operation of the safety valve; and closing the safety valve to block flow of well fluids at the subsurface location responsive to either of both sensed pressure changes in the well tubing.

2. The method as set forth in claim 1, including the step of:

increasing the well fluid pressure sensed by the safety valve for closing the safety valve by decreasing the flow of well fluids from the bore of the well tubing.

3. The method as set forth in claim 1, including the step of:

decreasing the well fluid pressure sensed by the safety valve for closing the safety valve by increasing the flow of well fluids from the bore of the well tubing.

4. The method as set forth in claim 1, including the step of:

blocking flow of well fluids from the bore of the well tubing for increasing the well fluid pressure sensed by the safety valve for closing the safety valve.

5. The method as set forth in claim 1, including the steps of:

increasing the pressure of the well fluids in the bore of the well tubing above the closed safety valve to exceed the pressure of the well fluids in the bore of the well tubing below the safety valve; and decreasing the pressure of the well fluids in the bore of the well tubing above the safety valve to the established preselected pressure for opening the safety valve to enable flow of well fluids through the bore of the well tubing.

6. A method of operating a well fluid ambient pressure responsive subsurface safety valve disposed in a well tubing to control the flow of well fluids through the bore of the tubing to control the flow of well fluids through the bore of the tubing including the steps of:

sensing with the safety valve both increasing and decreasing pressure changes in the well fluid pressure in the bore of the well tubing from a preselected ambient well fluid pressure for operating the safety valve; and closing the safety valve to block flow through the bore of the well tubing at the sursurface location responsive to either sensed pressure change in the bore of the well tubing.

7. The method as set forth in claim 6, including the step of:

increasing the well fluid pressure sensed by the safety valve for closing the safety valve by decreasing the flow of well fluids from the bore of the well tubing.

8. The method as set forth in claim 6, including the step of:

decreasing the well fluid pressure sensed by the safety valve for closing the safety valve by increasing the flow of well fluid from the bore of the well tubing.

9. The method as set forth in claim 6, including the step of:

blocking flow of well fluids from the bore of the well tubing for increasing the well fluid pressure sensed by the safety valve for closing the safety valve.

10. The method as set forth in claim 6, including the steps of:

increasing the pressure of the well fluids in the bore of the well tubing above the closed safety valve to exceed the pressure of the well fluids in the bore of the well tubing below the safety valve; and decreasing the pressure of the well fluids in the bore of the well tubing above the safety valve to the established preselected pressure for opening the safety valve to enable flow of well fluids through the bore of the well tubing.

* * * * *